US007086760B2

(12) United States Patent
Chuang

(10) Patent No.: US 7,086,760 B2
(45) Date of Patent: Aug. 8, 2006

(54) SUPPORT ROD AND SHEATH FOR LAMPSHADE

(76) Inventor: Mei-Chu Chuang, No 2, Alley 5, Lane 37, Shin-Shing St., ShuLin City, Taipei (TW)

( * ) Notice: Subject to any disclaimer, the term of this patent is extended or adjusted under 35 U.S.C. 154(b) by 47 days.

(21) Appl. No.: 10/843,343

(22) Filed: May 12, 2004

(65) Prior Publication Data

US 2005/0254247 A1 Nov. 17, 2005

(51) Int. Cl.
*F21V 11/00* (2006.01)

(52) U.S. Cl. ..... 362/351; 362/352

(58) Field of Classification Search ..... 362/351–352, 362/357–358, 278, 450; 403/329; 24/293–295, 24/297, 545
See application file for complete search history.

(56) References Cited

U.S. PATENT DOCUMENTS 3,023,307 A * 2/1962 Okamoto ..... 362/352
4,354,222 A * 10/1982 Gall ..... 362/352
6,527,421 B1 * 3/2003 Qing ..... 362/352
6,652,126 B1 * 11/2003 Lu ..... 362/352

FOREIGN PATENT DOCUMENTS

FR 2608255 A1 * 6/1988

* cited by examiner

*Primary Examiner*—John Anthony Ward
*Assistant Examiner*—Robert May
(74) *Attorney, Agent, or Firm*—Troxell Law Office, PLLC

(57) ABSTRACT

This invention relates to the improved support rod and the fixing sheath for the lampshade. The basic structure of the lampshade is composed of several upper and lower fixing sheaths, several support rods, a set of upper and lower trays and a shade body. The main characteristics of the design are that the support rods and the upper and lower fixing sheaths are clamped separately and the curved hooks of the upper and lower sheaths can be pre-hooked to the upper and lower trays and integrated with the outer shade, which is easy for assembling and disassembling without removing the outer shade. It is much easier and faster to pre-enclose the upper and lower fixing sheaths, the outer shade of the upper and lower trays, the separate clamping of the support rods leading to great saving in production cost in the fabrication and assembly of support rods and fixing sheaths.

1 Claim, 5 Drawing Sheets

SUPPORT ROD AND SHEATH FOR LAMPSHADE

FIELD OF THE INVENTION

This invention concerns a design of support rods and fixing sheaths for the lampshade, Simply speaking, in the assembly and disassembly of the lampshade, it is easy to connect each support rod on the periphery of the outer shade to the fixing sheath of upper and lower trays by separate clamping action, which achieves great saving in process of assembly and disassembly of the support rod and fixing sheath for the lampshade.

BACKGROUND OF THE INVENTION

The prior art of lampshade as indicated in the page 2 (line from 12 to 18) of the U.S. Pat. No. 6,672,743B1 which read "referring to FIG. 2, the support rod (4) is made of slightly elastic elongated metal strip. Each of two ends of the support rod (4) is enclosed in a fixing sheath (40). One end of an upper fixing sheath (40) is formed with a semicircular holding section (401), while one end of a lower fixing sheath (40) is formed with a hooking action (402) for respectively hooking and connecting with the upper and lower trays (2,3). The last line of page 2 also read that the upper and lower trays (2,3) and the support rods (4) are all enclosed and hidden in the shade body (1), as referring to FIG. 6, the outer shade body (1), upper and lower trays (2,3) and the support rods (4) of the lampshade are all independent components.

Based on the above state, enclosing the two ends of the support rod (4) in the fixing sheaths is made by means of pressing. In case of assembly and disassembly, it is absolutely necessary to remove the outer shade body (1) first, then take of each support (4) from the fixing sheath (40) from the upper and lower trays (2,3). When connecting the support rod (4) to the fixing sheath (40), it is an additional production cost. It is therefore really inconvenient for the industry to assemble and disassembly the lampshade in this manner. The connection of support rod (4) to the fixing sheath (40) is an expenditure of production cost, uneconomical for the lampshade industry.

The inventor know well the weaknesses of the prior art and has advocated great efforts for years in redesign and improvement and come up the novel improved support rod and fixing sheath. The major improvements is to pre-hook the upper and lower fixing sheaths to the upper and lower trays and the outer shade body to be integrated unit, it requires no removal of the shade body first in the assembling and disassembling. Each support rod on the periphery of the shade body is connected to the upper and lower fixing sheaths of the upper and lower trays, it is easy and fast for separating or clamping action to substitute the action where in the prior art, it requires to remove the outer shade body first before processing the assembly or disassembly the support rods from the fixing sheath from the upper and lower trays. This way of process achieve entire removal of inconvenience and lead to great saving in production cost of support rod and fixing sheath.

SUMMARY OF THE INVENTION

The major object of this invention is to provide an improved support rod and fixing sheath for the lampshade does easy assembly and disassembly without removing the outer shade body first. The upper and lower fixing sheath is pre-enclosed and connected to the upper and lower trays of the outer shade body and the support rod is then separately clamped to the fixing sheath. This way of process render great saving in production cost.

To achieve the above mentioned object, the technology this invention has ever applied is to have the lampshade composed of several upper and lower fixing sheaths; several support rods, a set of upper and lower trays and one outer shade. In particular, the structure of the support rod and the fixing sheath are designed for easy connection and disconnection. Each support rod can be easily connected to the upper and lower fixing sheath on the upper and lower trays. The fixing sheath contains two bent upright plates with a flap-up clamp at one end and two hooks in juxtaposition at the other end. The hooks are connected to the upper and lower trays and the outer shade body. The two ends of the support rod are inserted into the clamp formed by the upper and lower fixing sheath to constitute a complete frame to the support the outer shade body on the outer periphery of the outer shade. While in disassembly, it is easy to disconnect each support rod from the upper and lower fixing sheaths without removing the outer shade. The separate claming and connection make the work faster and easier.

The objects, features and advantages of the invention are explained in great detail with the aid of the preferable embodiment as illustrated in the drawings attached.

DETAILED DESCRIPTION OF THE INVENTION

Figure 1:
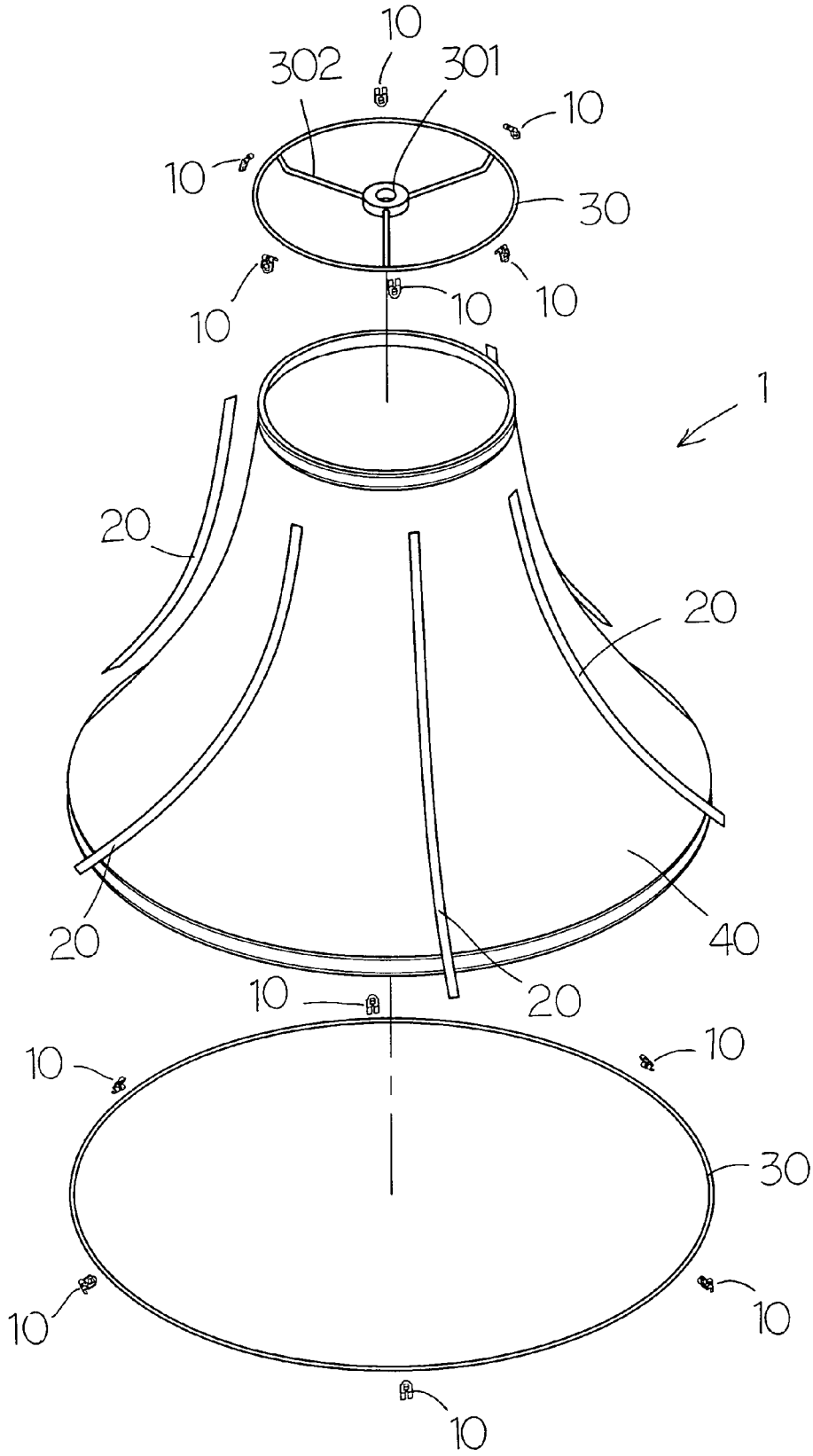
FIG. 1 shows the disassembly of the lampshade of this invention.
Figure 2:
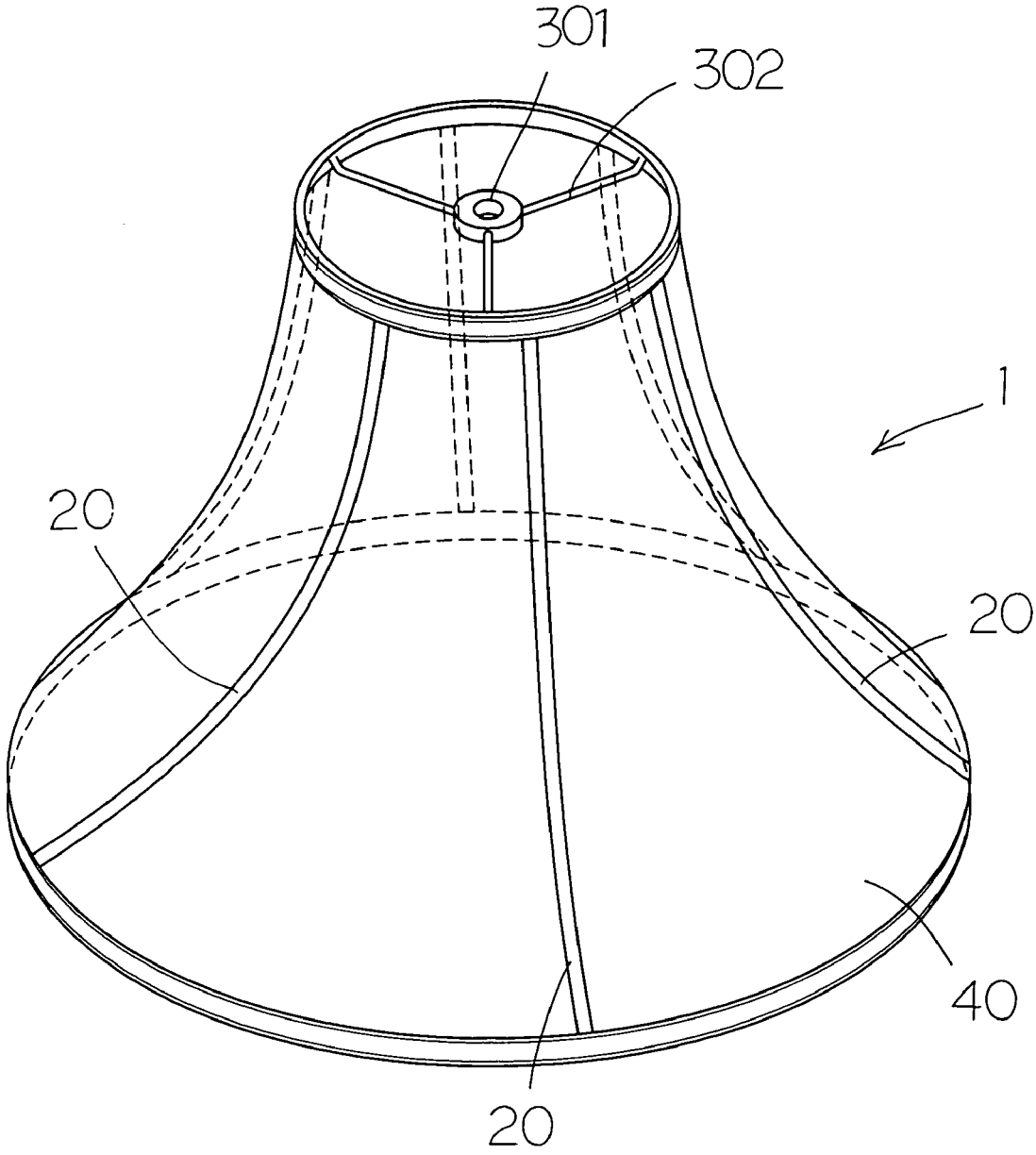
FIG. 2 shows the assembly of the lampshade of this invention.

As shown in FIGS. 1 and 2, the lampshade (1) at least comprises several upper and lower fixing sheaths (10), several support rods (20), a set of upper and lower trays (30) and an outer shade body (40). The fixing sheath (10) has one end formed with two bent side plates (102) and a flap-up clamp (103) for connecting the support rod (20) on the outer periphery of the outer shade (40). The other end of the fixing sheath has two hooks (101) disposed in juxtaposition and hooked on the upper and lower trays (30) and the outer shade (40) to form one unit.

Several support rod, made form the elastic elongated flat rod with two ends clamped in the clamp (103) of the fixing sheath (10).

A set of upper and lower tray (30) where the upper tray (30) has smaller diameter than the lower tray (30). The upper tray (30) has a retainer (301) with bending connecting rod extended to the periphery of the tray (30) so as to reinforce the frame.

An outer shade (40) is enclosed and connected to the upper and lower trays (30) supported by the support rod (20) which is connected to the clamp (103) of the upper and lower fixing sheaths (10) to support the hollow center shade so the light inside is therefore concentrated.

Figure 3:
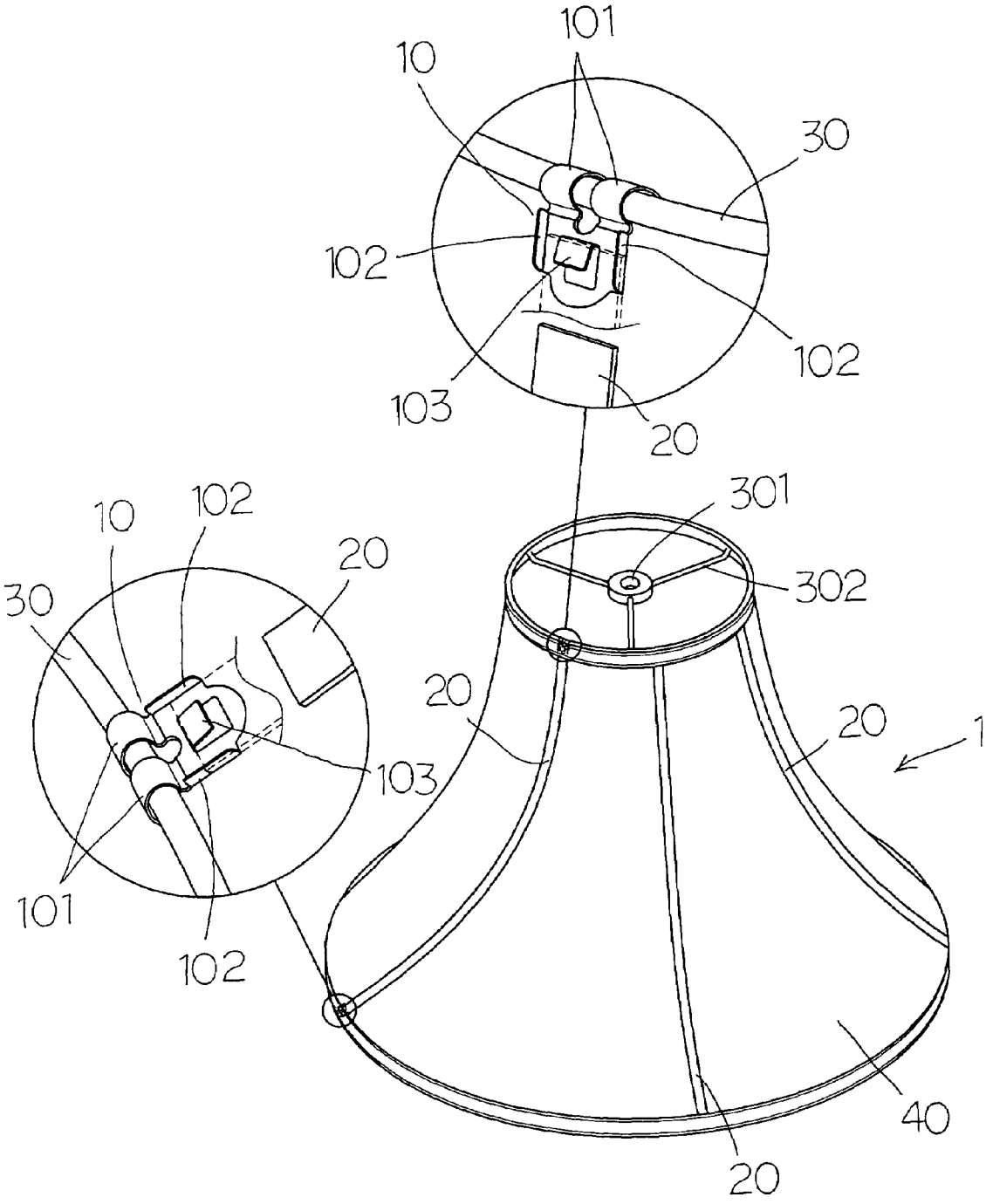
FIG. 3 shows the enlarged portion structure of the lampshade of this invention.
Figure 4:
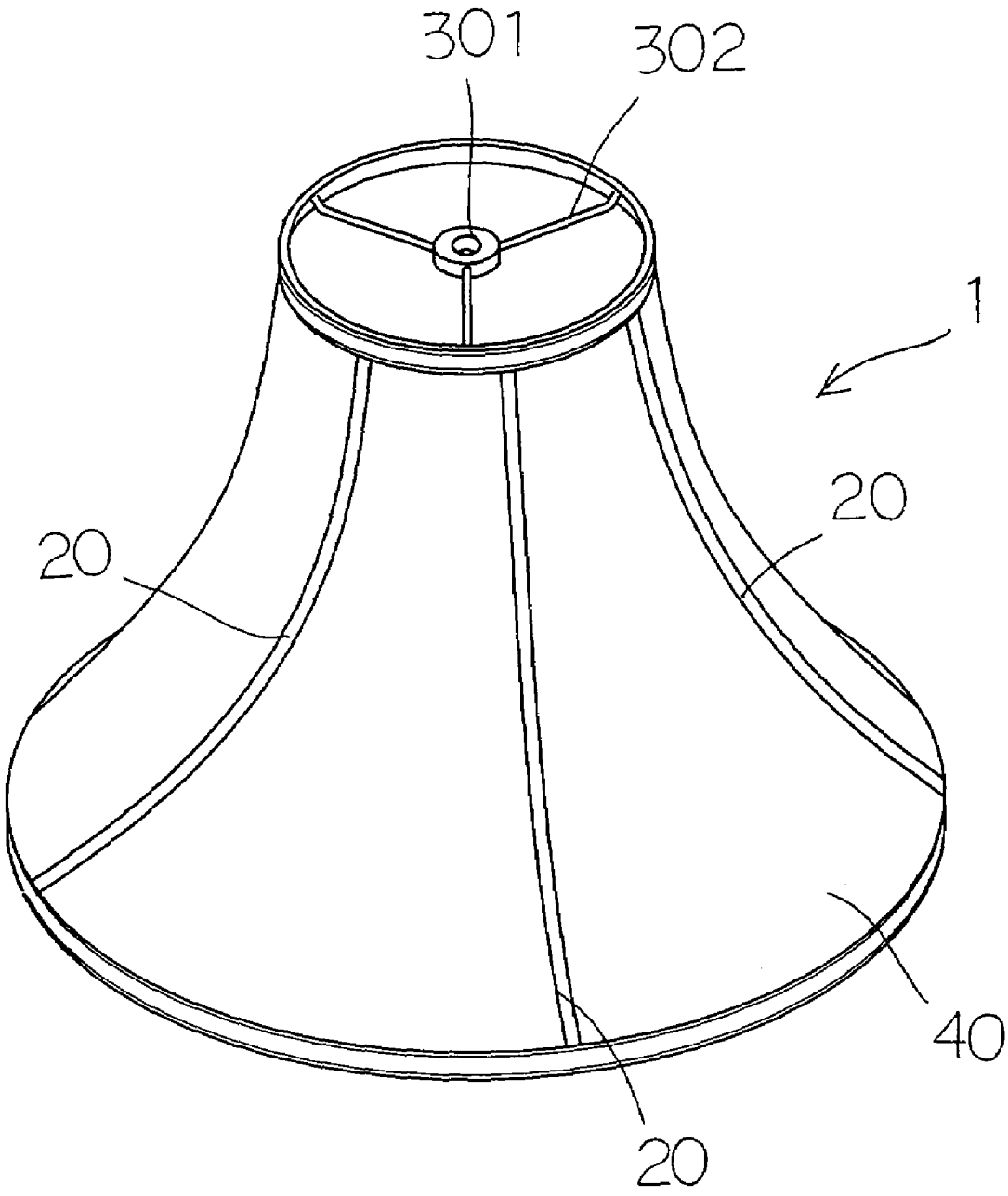
FIG. 4 shows another practical structure of the lampshade of this invention.

As shown in FIG. 3, the curved hooks (101) of the upper and lower fixing sheath (10) are first on the upper and lower trays (30) so the upper and lower fixing sheaths (10), the upper and lower trays (30) and the outer shade are enclosed and connected into one unit. The support rods (20) are distributed evenly along the periphery of the outer shade (40) and inserted into the clamp (103) of the flap-up side plate (102) to complete the enclosure and connection so a complete lampshade (1) is therefore assembled. As shown in FIG. 4.

Figure 5:
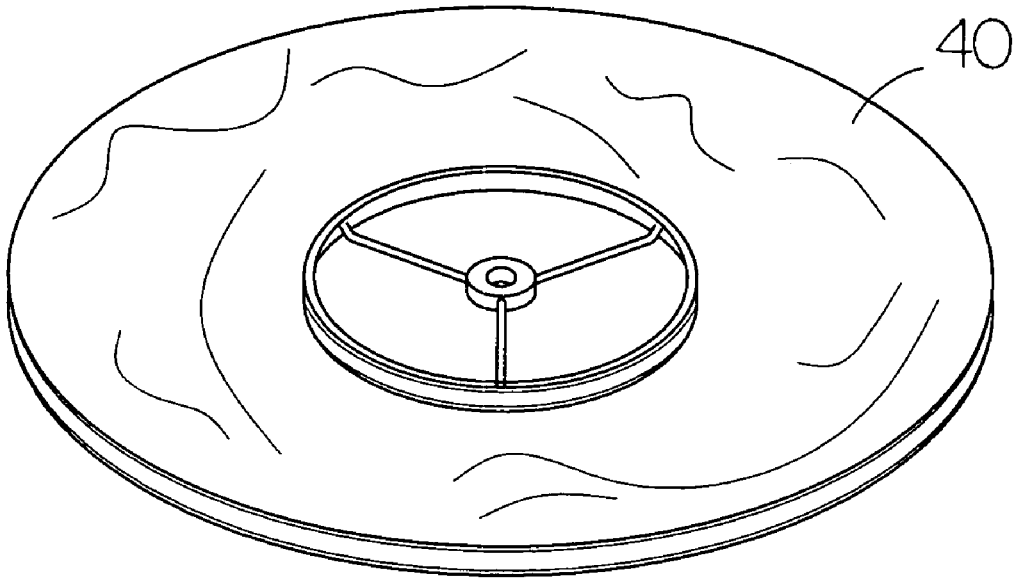
FIG. 5 shows another practical embodiment of the lampshade of this invention.
Figure 5:
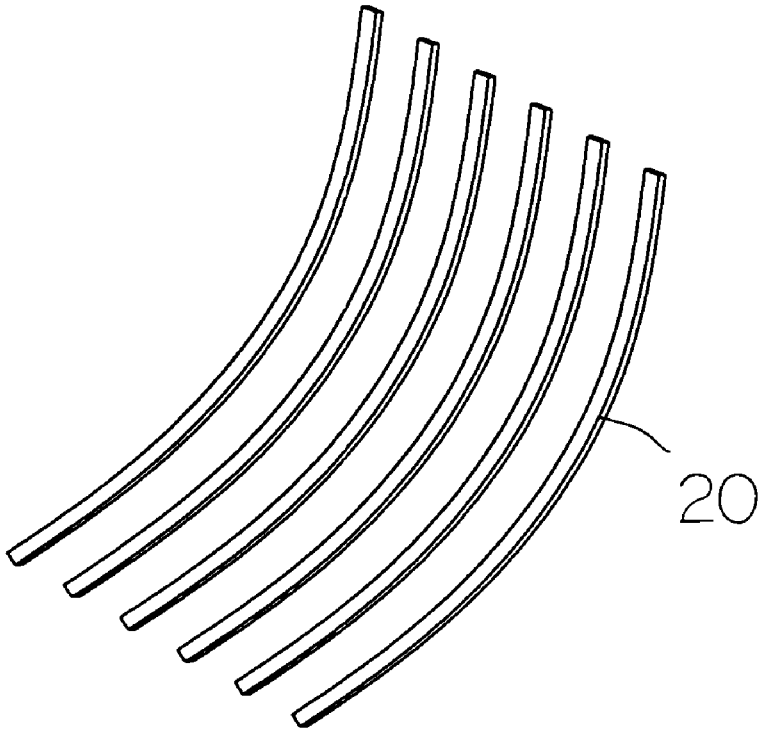

FIG. 5 is another embodiment of the lampshade where the upper and lower fixing sheaths (10), the outer shade (40) of the upper and lower trays (30) are enclosed and connected, but separated from the support rod (20). In the assembling work, just connect the support rod (20) to the upper lower fixing sheaths (10) of the upper and lower trays (30). It is easier to connect or to separate, render great saving in production of the support rod and the fixing sheath.

Viewing from the above statement, it is clear that the improved support rod and the fixing sheath will achieve the expected easy assembly and disassembly, it is very easy to enclose and connect the upper and lower fixing sheaths to the upper and lower trays and the outer shade, the support is therefore camped to the fixing sheaths in separate manner. This improvement has never been appeared in any publication justified for granting a patent.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

The invention claimed is:

1. A lamp shade assembly comprising:

a) a plurality of fixing sheaths including a plurality of upper fixing sheaths and a plurality of lower fixing sheaths, each of the plurality of fixing sheaths having:
   i) two bent side plates located on a first end thereof;
   ii) a flap-up clamp located between the two bent side plates; and
   iii) two hooks located on a second end thereof;

b) an upper tray connected to the two hooks of each of the plurality of upper fixing sheaths;

c) a lower tray connected to the two hooks of each of the plurality of lower fixing sheaths;

d) an outer shade body connected to the upper tray and the lower tray; and e) a plurality of support rods having:
   i) a first end selectively connected to the two bent side plates and the flap-up clamp of each of the plurality of upper fixing sheaths; and
   ii) a second end selectively connected to the two bent side plates and the flap-up clamp of each of the plurality of lower fixing sheaths.

* * * * *